US006244338B1

(12) United States Patent
Mones

(10) Patent No.: US 6,244,338 B1
(45) Date of Patent: Jun. 12, 2001

(54) SYSTEM FOR IMPROVING COALBED GAS PRODUCTION

(75) Inventor: Charles G. Mones, Cheyenne, WY (US)

(73) Assignee: The University of Wyoming Research Corp.,

( * ) Notice: Subject to any disclaimer, the term of this patent is extended or adjusted under 35 U.S.C. 154(b) by 0 days.

(21) Appl. No.: 09/338,295

(22) Filed: Jun. 23, 1999

Related U.S. Application Data

(60) Provisional application No. 60/090,306, filed on Jun. 23, 1998.

(51) Int. Cl.[7] ..... E21B 43/25; E21B 43/30; E21B 47/00

(52) U.S. Cl. ..... 166/245; 166/52; 166/90.1; 166/250.01; 166/263; 166/268

(58) Field of Search ..... 166/52, 66, 90.1, 166/250.01, 252.1, 252.5, 245, 263, 268, 305.1, 308; 299/12

(56) References Cited

U.S. PATENT DOCUMENTS

| | | | | |
|---|---|---|---|---|
| 4,043,395 | | 8/1977 | Every et al. | 166/263 |
| 4,544,037 | | 10/1985 | Terry | 166/369 |
| 4,756,367 | | 7/1988 | Puri et al. | 166/263 |
| 4,883,122 | | 11/1989 | Puri et al. | 166/263 |
| 5,014,785 | | 5/1991 | Puri et al. | 166/263 |
| 5,085,274 | * | 2/1992 | Puri et al. | 166/252.1 |
| 5,388,640 | * | 2/1995 | Puri et al. | 166/263 |
| 5,388,641 | * | 2/1995 | Yee et al. | 166/263 |
| 5,388,642 | * | 2/1995 | Puri et al. | 166/268 X |
| 5,402,847 | * | 4/1995 | Wilson et al. | 166/263 |
| 5,417,286 | | 5/1995 | Palmer et al. | 166/308 |
| 5,419,396 | | 5/1995 | Palmer et al. | 166/250 |
| 5,439,054 | * | 8/1995 | Chaback et al. | 166/268 X |
| 5,454,666 | | 10/1995 | Chaback et al. | 405/52 |
| 5,494,108 | | 2/1996 | Palmer et al. | 166/308 |
| 5,501,273 | * | 3/1996 | Puri | 166/245 X |
| 5,501,279 | | 3/1996 | Garg et al. | 166/372 |
| 5,566,755 | | 10/1996 | Seidle et al. | 166/263 |
| 5,566,756 | | 10/1996 | Chaback et al. | 166/263 |
| 5,865,248 | | 2/1999 | Riese et al. | 166/263 |

OTHER PUBLICATIONS

Reznik, A., et al, "Enhanced Recovery of In Situ Methane by Carbon–dioxide Injection: An Experimental Feasibility Study", Fossil Energy, May 1982, 38 total pages.

Mones, C., "Development of a Portable Data Acquisition System and Coalbed Methane Simulator, Part 2: Development of a Coalbed Methane Simulator", Final Report, Apr. 1998, 228 pages total.

* cited by examiner

*Primary Examiner*—George Suchfield
(74) *Attorney, Agent, or Firm*—Santangelo Law Offices, P.C.

(57) ABSTRACT

A method of stimulating coalbed methane production by injecting gas into a producer and subsequently placing the producer back on production is described. A decrease in water production may also result. The increase in gas production and decrease in water production may result from: (1) the displacement of water from the producer by gas; (2) the establishment of a mobile gas saturation at an extended distance into the coalbed, extending outward from the producer; and (3) the reduction in coalbed methane partial pressure between the coal matrix and the coal's cleat system.

33 Claims, 9 Drawing Sheets

○ = Unstimulated producer

△ = Stimulated producer

○ = Unstimulated producer

△ = Stimulated producer

SYSTEM FOR IMPROVING COALBED GAS PRODUCTION

This application claims the benefit of the provisional application Ser. No. 60/090,306 filed on Jun. 23, 1998.

BACKGROUND OF THE INVENTION

Generally, this invention relates to the improved production of coalbed gas from substantially solid subterranean formations including coalbeds. Specifically, this invention relates to the use of a stimulation gas to manipulate the physical and chemical properties of such subterranean formations and to increasing the quantity, quality and rate of production of coalbed gases associated with such subterranean formations.

A significant quantity of coalbed gas is physically bound (or sorbed) within coalbeds. This coalbed gas, which was formed during the conversion of vegetable material into coal, consists primarily of methane. Because it is primarily methane, coal gas is commonly termed coalbed methane. Typically, more than 95% of the coalbed methane is physically bound (adsorbed) onto the surface of the coalbed matrix.

Coal may be characterized as having a dual porosity character, which consists of micropores and macropores. The micropore system is contained within the coal matrix. The micropores are thought to be impervious to water; however, the vast majority of coalbed methane contained by the coalbed is adsorbed onto the walls associated with the micropores. The macropores represent the cleats within the coal seam. Face and butt cleats are interspersed throughout the coal matrix and form a fracture system within the coalbed. The face cleats are continuous and account for the majority of the coalbed's permeability. Butt cleats are generally orthogonal to the face cleats but are not continuous within the coal. On production, the coalbed matrix feeds the cleat system and the desorbed coalbed gas is subsequently removed from the coalbed at production wells.

Several important problems limit the economic viability of coalbed methane production. The first is the handling of produced water from water-saturated coalbeds. The handling of produced water can be a significant expense in coalbed methane recovery. In a typical water-saturated reservoir, water must first be depleted to some extent from the cleat system before significant coalbed methane production commences. Water handling involves both pumping and disposal costs. If the coalbed is significantly permeable and fed by an active aquifer, it may be impossible to dewater the coal and induce gas production. Production of significant quantities of water from an active aquifer may be legally restricted and may result in lawsuits from others who rely on the affected water supply. Disposal of the produced water can present several problems. The water may be discharged to the surface and allowed to evaporate. If sufficiently clean, the water may be used for agricultural purposes. Finally, the water may be reinjected into the coal. All of these disposal methods require environmental permitting and are subject to legal restrictions. Many conventional coalbed gas production systems only displace water in the vicinity of the production well which results in a short coalbed gas production period which lasts only hours or a few days. One example is disclosed in U.S. Pat. No. 4,544,037. Gas production stops when the water returns to the coalbed surrounding the production well.

The second problem which limits the economic viability of coalbed gas production is maintaining the appropriate removal rate of coalbed gas as it is desorbed from the coalbed. As the pressure in the immediate vicinity of the producer decreases, a quantity of gas desorbs from the coal and begins to fill the cleat system. If the water is excluded from the coalbed surrounding coalbed gas production well, and as gas desorption continues, the gas phase becomes mobile and begins to flow to the low-pressured producer. With the existence of a mobile gas phase, the pressure drawdown established at the production well is more efficiently propagated throughout the coalbed. Gas more efficiently propagates a pressure wave compared to water because gas is significantly more compressible. As the pressure decline within the coalbed continues, gas desorption, and therefore gas production, accelerates.

There is an important relationship between these two present production problems. The rate of gas diffusion from the coal can only be maximized by maintaining the lowest possible production well pressure, however, excessively low pressures increase water production. Conventional production practices overcome the diffusion-limited desorption of methane from the coal matrix by using such excessively low production well pressures, or do not set coalbed gas removal rates as disclosed in U.S. Pat. No. 4,544,037, allowing rate-controlling diffusion of coalbed gas and water encroachment to limit the economic life of the coalbed methane production well.

A related problem is coalbed structure water permeability. Increased water permeability allows water that is displaced from a coalbed to return more rapidly which results in increased waterhandling or a shorter economic lifespan of the coalbed reservior. Conventional production techniques do not effectively deal with the water permeability of the coalbed structure.

Another conventional coalbed gas production problem is the contamination of the coalbed gas removed from the coalbed with stimulation gas. As but one example, Amoco Production Co. (Amoco) has developed a method of increasing coalbed methane production by increasing the pressure difference between the coal matrix and the cleat system (diffusional, partial-pressure driving force) (U.S. Pat. No. 4,883,122). As that patent discloses, Amoco injects an inert stimulation gas (such as nitrogen) into an injection well. Nitrogen is less sorptive than coalbed methane and tends to remain in the cleat space. The injected nitrogen drives the resulting gas mixture to one or more producing wells, where the mixture is recovered at the surface. By the end of a year's production, the product gas may contain approximately 20 volume percent nitrogen. The simulated production rate profiles resulting from a continuous nitrogen injection are shown in FIG. 5. The point labeled P in FIG. 5 is the production rate immediately prior to application of the stimulation gas enhanced method. As is evident, the increase in gas production due to nitrogen injection is immediate and substantial. Much of the dramatic increase in early-time gas production results from the reduction in partial pressure of methane in the cleat system. Part of the improved recovery results from the increase in reservoir pressure that results from the injection of nitrogen into the coalbed. However, much of the production over the long term contains quantities of nitrogen which are substantially higher than minimum standards for pipeline natural gas.

Similarly, other ECBM methods which are designed to desorb gas by the injection of gas into an injection well and recover gas mixtures at one or more producing wells have high levels of contaminating stimulation gas in the coalbed gas removed at the production well. These techniques generally employ the use of $CO_2$ or $CO_2$-nitrogen mixtures as disclosed by U.S. Pat. Nos. 5,454,666 and 4,043,395; and as disclosed in an Alberta Research Council (press release). $CO_2$ is more sorptive than methane and tends to be adsorbed by the coal matrix. Therefore, the response of methane at the producers is attenuated. However, as with the above mentioned methods, these ECBM methods produce coalbed gas with high levels of stimulation gas. Therefore, as with the other above mentioned methods a gas cleanup process is required.

Another problem with injection of stimulation gas into a separate well located a distance from the production well is the production of increased water. In fact, Amoco's ECBM technique may increase overall water production because the increased quantity of coalbed gas that results from this injection-desorption process may tend to sweep additional quantities of water to the producer.

Yet another problem with convention coalbed gas production is high cost. Many of the above mentioned methods use stimulation gas at high pressure which requires the use of expensive, high-capacity, multistage gas compressors. Similarly, other methods also use high pressure as disclosed by U.S. Pat. Nos. 5,419,396; 5,417,286; and 5,494,108. High costs are also associated with the use of carbon dioxide gas as disclosed by U.S. Pat. No. 4,043,395, and in the continuous use of coalbed gases during coalbed gas production as disclosed by U.S. Pat. Nos. 4,883,122; 5,014,785; and 4,043,395.

Each of these problems of conventional coalbed gas production are addressed by the instant invention disclosed.

SUMMARY OF INVENTION

Accordingly, the broad goal of the instant invention to increase coalbed gas recovery by stimulation of the coalbed formation. The invention improves on the previously mentioned ECBM recovery techniques. The present invention comprises a variety of coalbed stimulation techniques which are applied to coalbed methane production wells. The techniques serve to displace and confine water, alter the permeability of coalbed fracture systems, establish optimal coalbed stimulation gas amounts and coalbed gas removal rates, and as a result operate to limit water production rates in water-saturated coalbeds and reduce stimulation gas content in produced coalbed gas. The methods are simple, economical and time efficient. Naturally, as a result of these several different and potentially independent aspects of the invention, the objects of the invention are quite varied.

Another of the broad objects of the invention is to provide a numerical simulator which simulates the flow of water and gas phases around wells which communicate with coalbed gas. Simulation of gas desorption and sorption between the coalbed and the cleat system and the interrelated effects of pressure gradients, fluid viscosity, absolute permeability and liquid-gas phase permeability allows prediction of coalbed gas production. This allows various aspects of the instant invention to be optimized which when used separately or in combination increase coalbed gas production.

Yet another object of the invention is to eliminate the necessity for separate coalbed gas stimulation injection wells and coalbed gas production wells. As mentioned above most conventional coalbed production practices use a separate stimulation injection well and a separate coalbed gas production well. This practice leads to a variety of problems with water handling and contamination of the coalbed gas produced. It is therefor desirable to establish a method which uses the production well for both stimulation gas injection and also for coalbed gas removal.

Another object of the invention is the convenient and effective water displacement or confinement of water which surrounds coalbed gas production wells. Water handling as mentioned above is both costly and inconvenient. An effective method of displacing water from a large area of the coalbed surrounding the production well into the adjacent coalbed area would eliminate the necessity of handling at least a portion of that coalbed water.

Another object of the invention is to establish a reduced water permeability of the coalbed so as to exclude at least of portion of the displaced water. A reduced water permeability coalbed prevents or slows the rate of water encroachment around production wells. From the point of commercializing production of coalbed gas, having less water in the coalbed gas reservoir translates into less water to handle and to dispose of, increased coalbed gas recovery, and coalbed bed gas with less water content. By eliminating the problems associated with coalbed water, production rates are increased and there is less cost per unit volume of production.

An additional object of the invention is to produce clean coalbed gas from a stimulated coalbed. Coalbed gas containing less than about four per cent per unit volume of stimulation gas does not have to be cleaned up before it is used. Clean coalbed gas, as a result, costs less to produce per unit volume than coalbed gas produced using conventional stimulation techniques. A predictable method of producing clean coalbed gas is therefor highly desirable.

Another object of the invention is to calculate the rate at which coalbed gas should be removed from the coalbed or other subterranean formation. Desorption of coalbed gas from coalbed formations is a rate limiting step with regard to production. Desorption of coalbed gas is increased when the coalbed is stimulated and when the desorbed gas is removed. Optimal removal rates of coalbed gas from the production well establishes a desirable balance between a lowered pressure which induces continual desorption of coalbed gas from the coal matrix and yet not so low as to draw previously displaced water back into the coalbed reservoir.

Another object of the invention is to reduce the cost of coalbed gas production. Most conventional coalbed gas stimulation techniques utilize continuous high pressure injection of stimulation gas during the production of coalbed gas. Additionally, many techniques utilize purified gas which necessitates fractionation of atmospheric gas. This necessitates the long term use of expensive multistage gas compressors and fractionation equipment. Moreover, many techniques also require separate injection wells and production wells and then subsequent purification of the produced coalbed gas. As such, these techniques may be prohibitively expensive to use. The instant invention, eliminates many of these expensive features and steps allowing coalbed gas to be produced at a considerably lower cost.

DESCRIPTION OF THE PREFERRED EMBODIMENTS

As can be easily understood, the basic concepts of the present invention may be embodied in a variety of ways. It involves both treatment techniques as well as devices to accomplish the appropriate treatment. In this application, the treatment techniques are disclosed as part of the results shown to be achieved by the various devices described and as steps which are inherent to utilization. They are simply the natural result of utilizing the devices as intended and described. In addition, while some devices are disclosed, it would be understood that these not only accomplish certain methods but also can be varied in a number of ways. Importantly, as to all of the foregoing, all of these facets should be understood to be encompassed by this disclosure.

Figure 1:
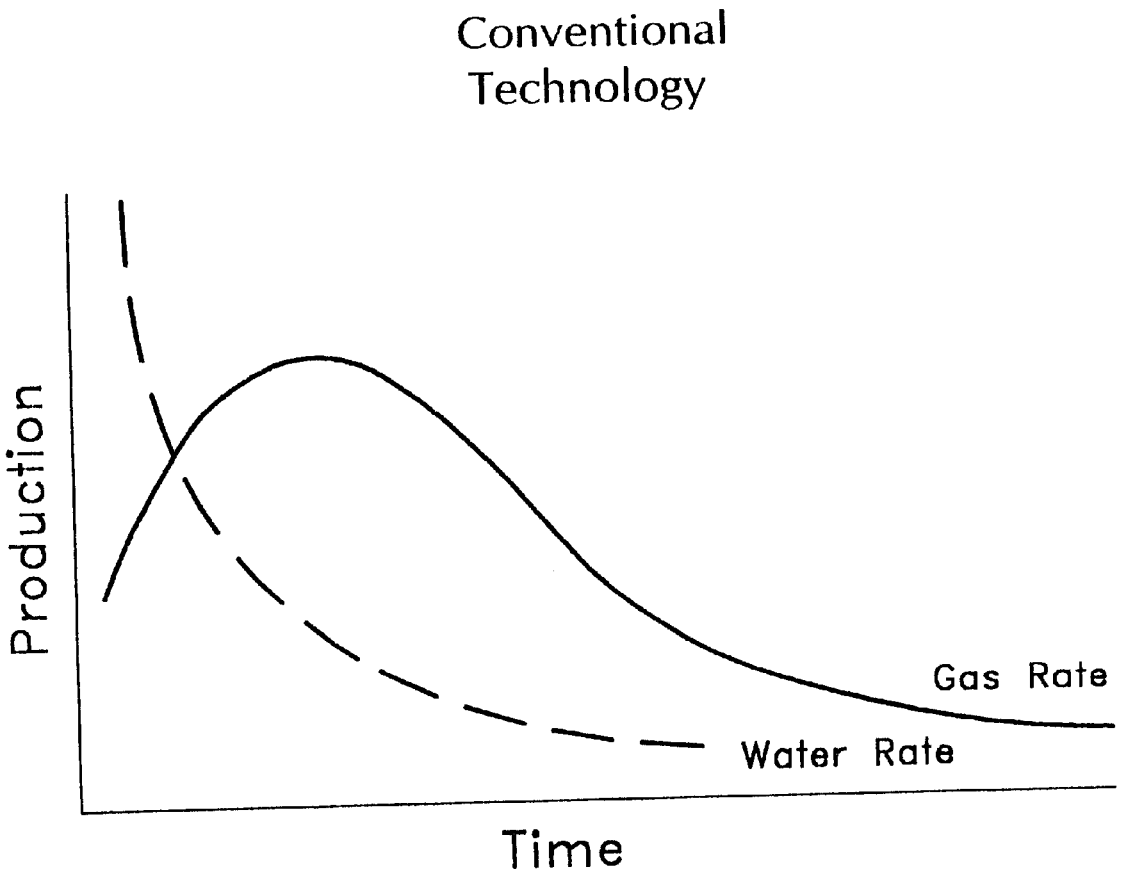
FIG. 1 is a graph of typical coalbed production rates using conventional recovery techniques.
Figure 2:
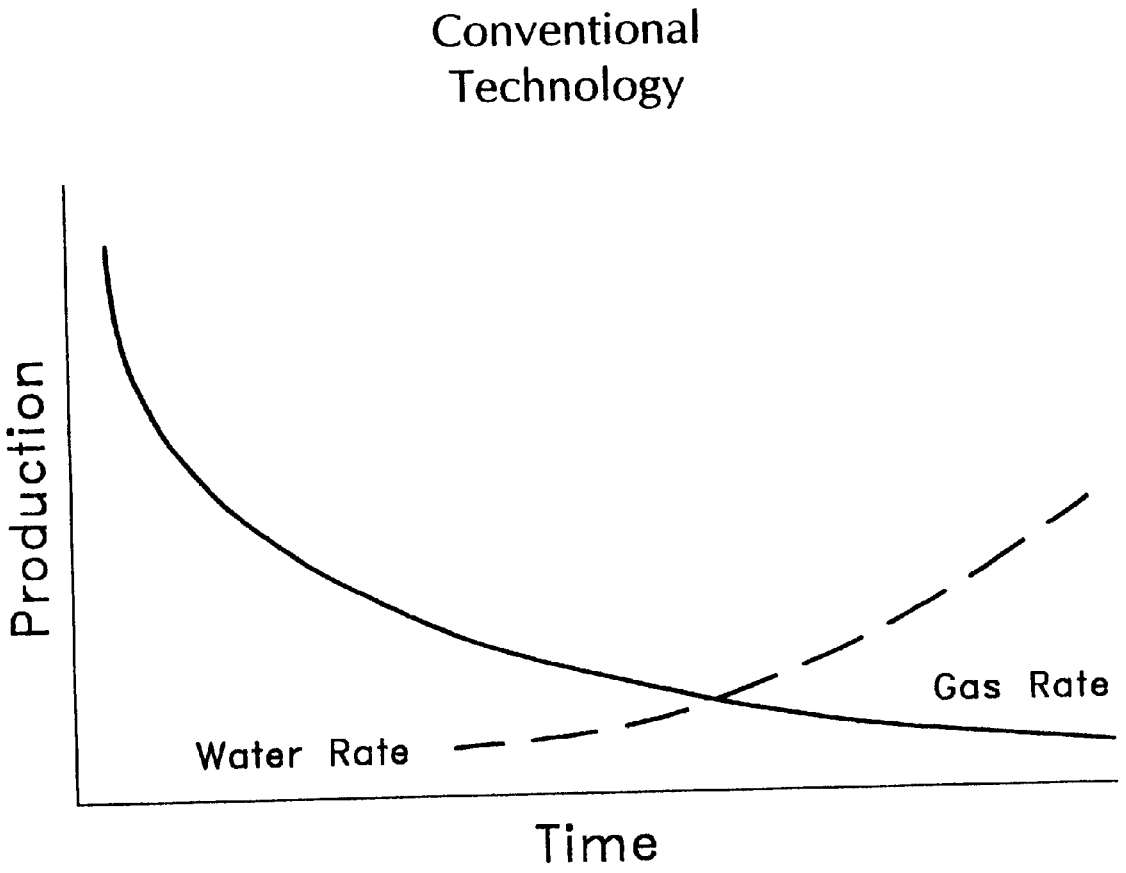
FIG. 2 is a graph of typical sandstone production rates using conventional recovery techniques.

FIGS. 1 and 2 are generally representative of conventional gas production profiles for typical coalbed and sandstone formations. Production from the coalbed formation (FIG. 1) is characterized by an initial period of high water production and low gas production. The gas production rate increases with the partial depletion of water and the lowering of pressure in the coalbed. As described earlier, the lowering of pressure results in the desorption of coalbed methane from the coal matrix. The gas rate falls off in the later stages of production. This decline in production results from at least two factors: (1) a depletion of sorbed methane from the coal and (2) a rate-controlling diffusion of gas from the coal that is related to the difference in pressure between the coal matrix and the cleat system.

Figure 4:
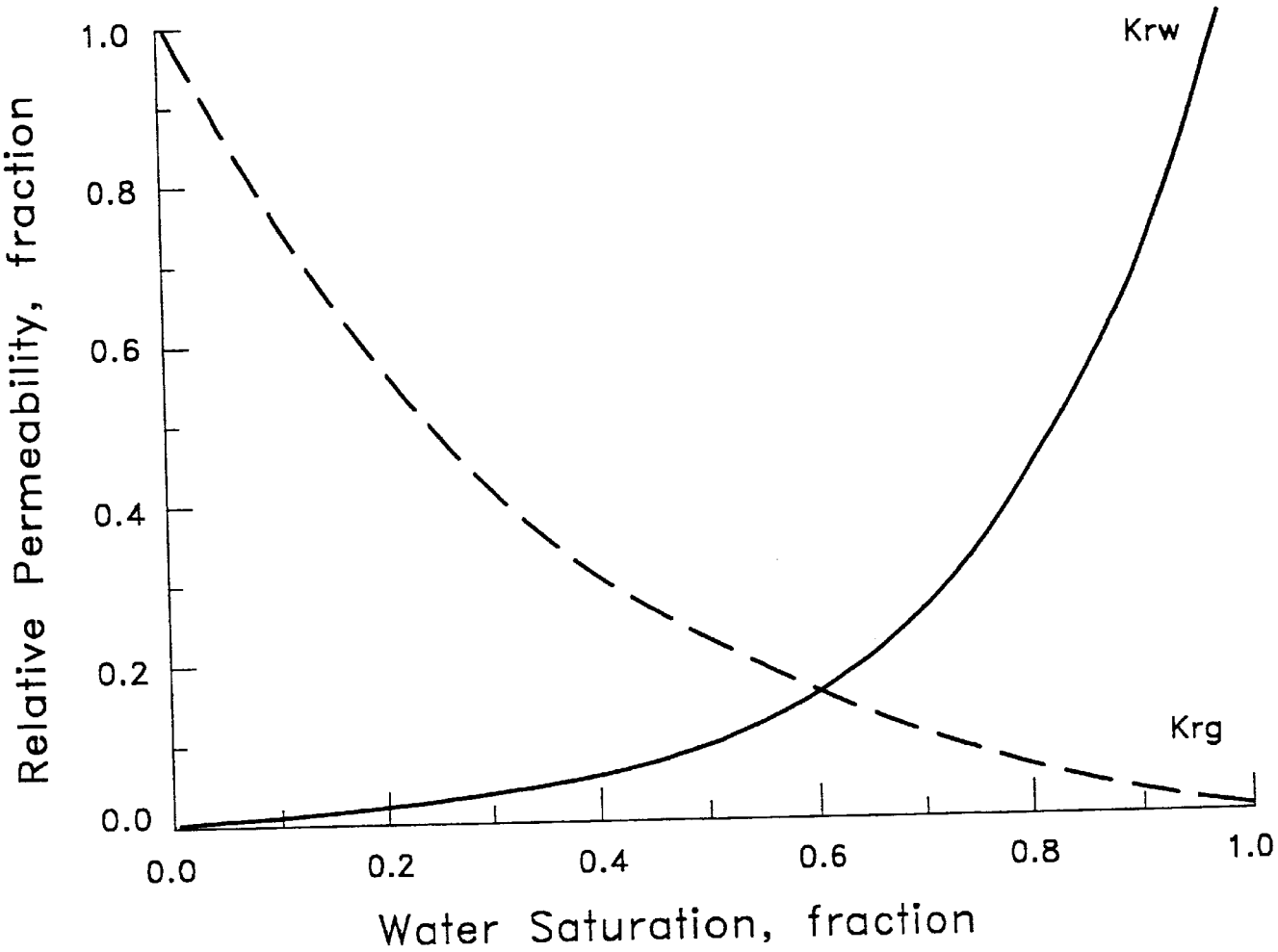
FIG. 4 is a graph of the relative ability of water and gas to flow as a function of the water saturation of a coalbed.
Figure 5:
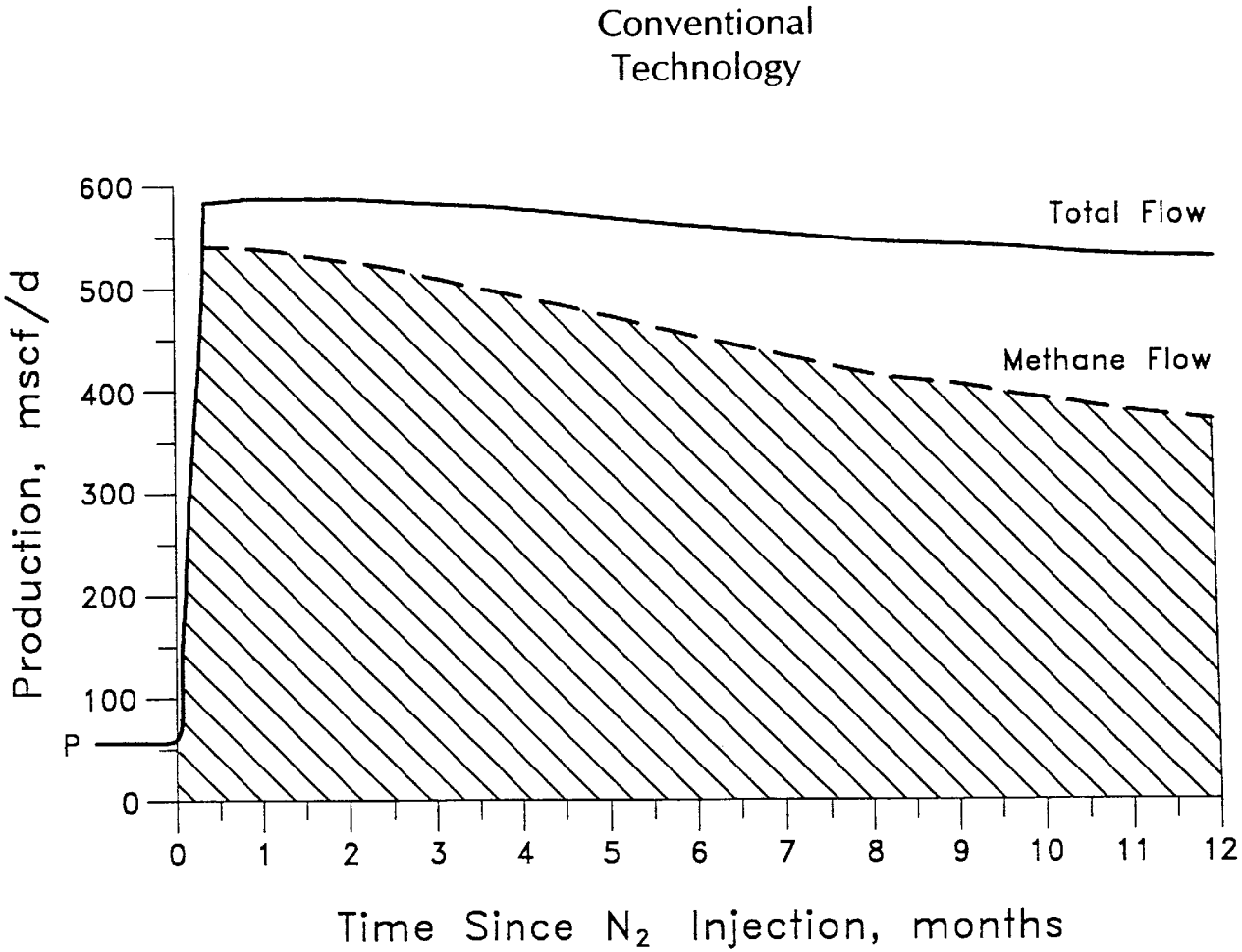
FIG. 5 is a graph of a simulated conventional production history of a coalbed continuously stimulated with nitrogen gas.

In comparison, the gas production from a sandstone formation is often related only to reservoir pressure (FIG. 2). The gas is contained within the sandstone's pore space. Gas production is highest initially because reservoir pressure and gas content are at a maximum. Production rate declines as gas content and, therefore, reservoir pressure declines. Water rate increases as pressure declines, either because of water encroachment or because of an increase in the permeability to water as the pore space collapses as shown in FIG. 4.

The production of coalbed methane from a water-saturated coal resource with the instant invention may involve displacing water surrounding the production well or wells without disrupting the coalbed structure or confinement of the displaced water so that it does not encroach upon the dewatered coalbed gas reservoir during coalbed gas production. This can be subsequently followed by the following three steps: (1) production of gas and lowering of pressure in the immediate vicinity of the wellbore; (2) the desorption of coalbed methane from the coal matrix into the cleats due to the pressure reduction; and (3) the accelerated production of mobile coalbed methane gas from the coalbed as the radius of influence of the pressure drawdown increases throughout the coalbed. The present invention operates to improve the efficiency of all these production steps and production mechanisms.

Figure 3:
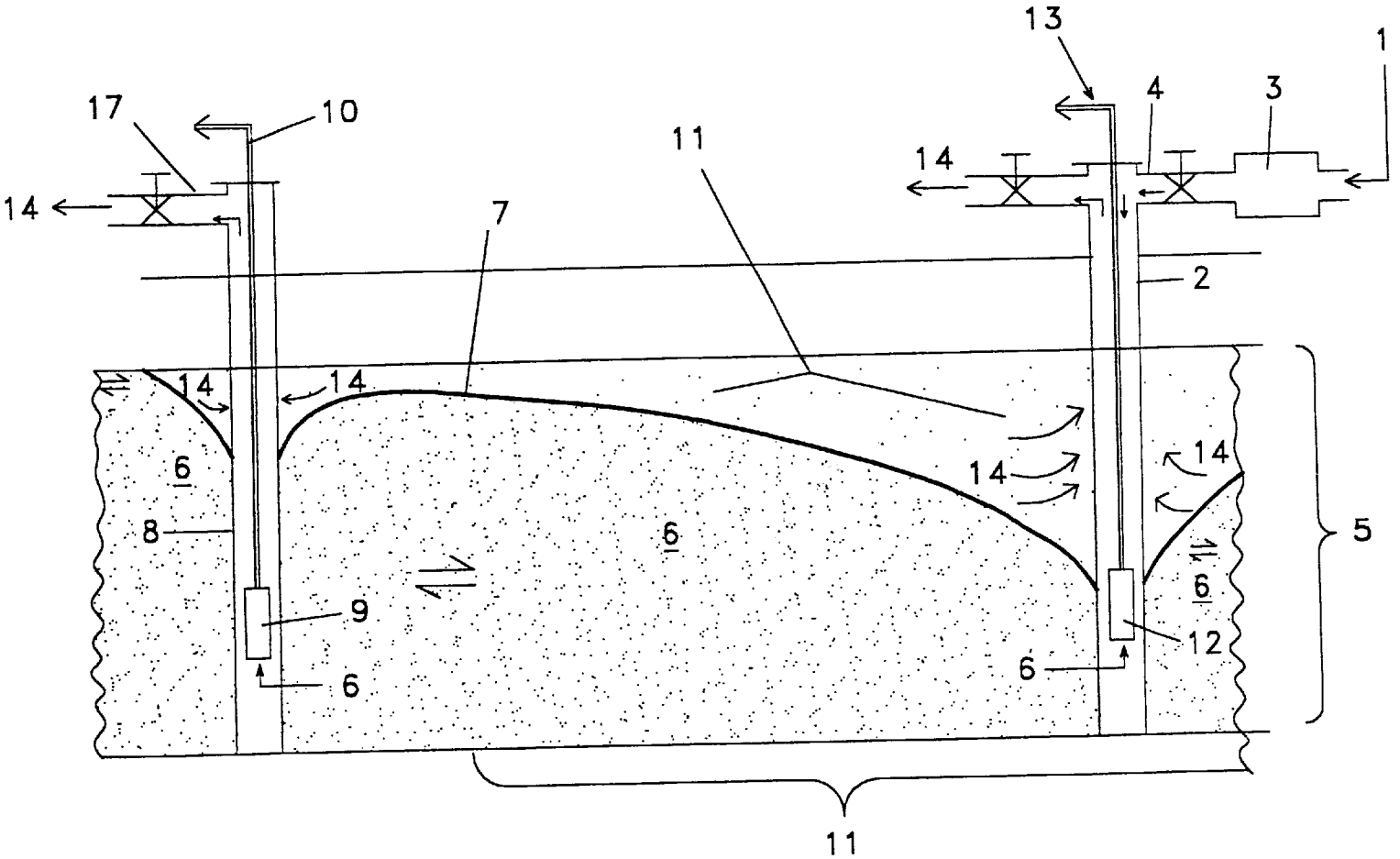
FIG. 3 is a drawing of a particular embodiment of the instant invention.

As depicted in FIG. 3, The present invention stimulates a producer by injecting an appropriate quantity or amount of coalbed stimulation gas (1) into at least one production well (2). This is accomplished by using a compressor or other stimulation gas transfer element (3) perhaps joined to the annular region production well by a gas plenum having control valves or other production well coupling element (4) responsive to both the stimulation gas transfer element and the production well. The injected stimulation gas flows into the coalbed (5) in the vicinity of the production well. Conceivably, any gas can be used, but the most preferable is a gas that is less sorptive than methane, such as nitrogen but may also be carbon dioxide. The optimum injection gas may be air because it's free and is 80% nitrogen. Water (6) which is associated with the coalbed or a part of the coalbed surrounding the production well has a hydrostatic pressure. The coalbed stimulation gas (1) can be delivered to the coalbed at a pressure greater than that of the hydrostatic pressure of the water and the water is displaced a distance from the well. With continued injection, a region of gas saturation is established at an extended distance into the coalbed thereby establishing a water displacement perimeter (7). This operation effectively partially de-waters the coalbed without producing water to the surface. Optimally, the pressure is not substantially larger than the hydrostatic pressure of the water so as not to disrupt the coalbed structure. One or more water confinement wells (8) may be established a distance from the production well or at the water displacement perimeter or at the production well drainage radius to remove water encroaching upon the production well. Removal of water may be accomplished by use of a pump or other water transfer element (9) coupled to the confinement well through a variety of water confinement coupling elements (10). At least water is removed from the confinement wells although gas may also be removed from the stimulated coalbed reservoir from the confinement well as necessary to assist the production well in removal of coalbed gas from the coalbed gas reservoir at the required removal rate through various coupling elements. The area swept by the injected coalbed stimulation gas by this method may be significantly greater than the radius of pressure drawdown that results from initially de-watering a well by conventional production methods. Assuming the injected gas is composed substantially of nitrogen, the coalbed's cleat system is initially occupied by a gas that contains little methane (15).

At the time the injection of coalbed stimulation gas ceases and the production well is about to be placed on production by lowering its pressure any of the following conditions have been created by the stimulated coalbed gas reservoir (11) which should improve gas production rate at the production well and reduce the water production rate at the production well compared to conventional production methods. First, at least a partial saturation of coalbed stimulation gas has been established at an extended distance into the coalbed. As a result, the partial pressure driving force for coalbed methane desorption is high. This saturation will also serve as an efficient medium for transferring through the cleat system or drawdown the reduction in pressure of water. This drawdown may be accomplished by a pump or water removal element (12) coupled to the production well with any of a variety of production well coupling elements (13) that results from simultaneously removing coalbed gas and water from the coalbed by means of the production well for producer.

Second, the water saturation has been decreased, which reduces its ability to flow to the producer. The ability of water to flow (water permeability of the coalbed) as a function of water saturation is conceptually depicted in FIG. 4. In a gas-water system, permeability to water drops as the water saturation decreases. The ability of a well to produce water is directly proportional to the coalbed's permeability to water, as shown by the equation:

$$qw = PI \times Krw \times \Delta P, \text{ where}$$

qw=water production rate from a producer;

PI=productivity index of the well;

Krw=relative permeability to water; and

ΔP=difference in pressure between producing well and adjacent coalbed.

Conversely, because of the increased gas saturation, the permeability to gas, and therefore its production rate, will be increased.

Figure 6:
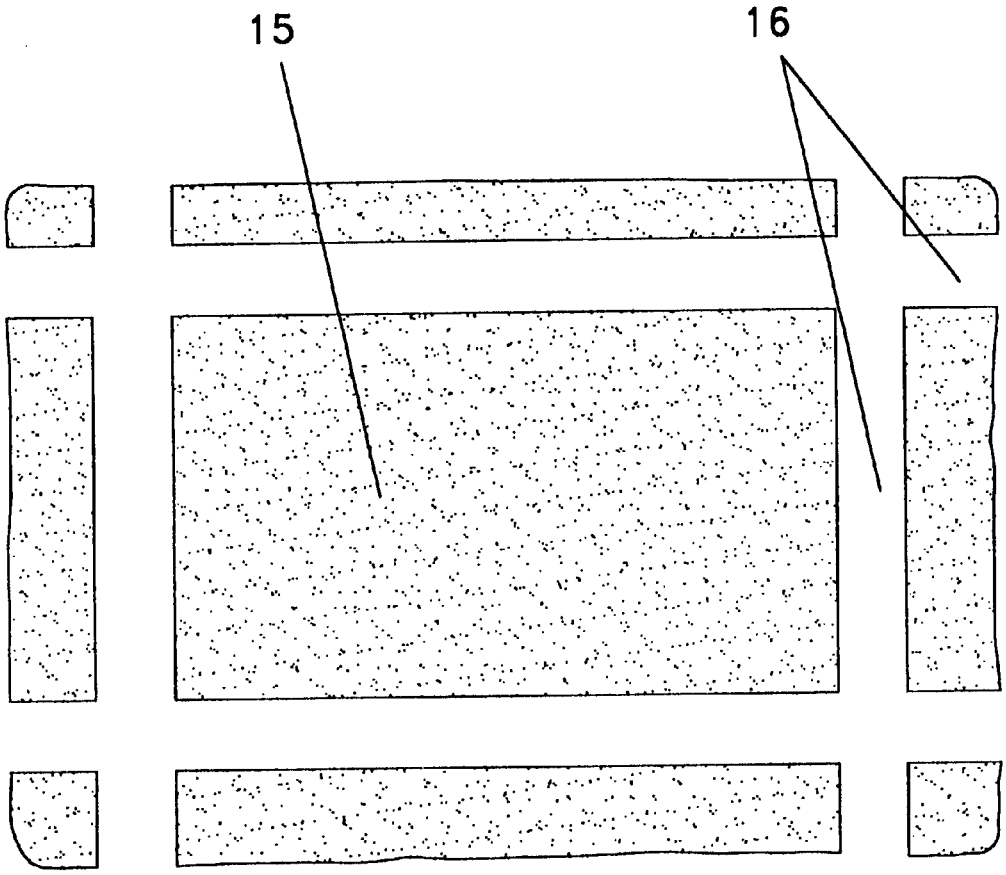
FIG. 6 is a depiction of the dual porosity structure of coal.

Third, the coalbed stimulation gas injected into the cleat system will initially promote a reduced methane content (i.e., concentration) in the cleats, which will increase the desorption rate of methane from the coal matrix to the coal's cleat system by the method of partial pressure reduction. The dual porosity structure in coal is depicted in simple form in FIG. 6. Recall that the cleat system is drained by the producing wells, and notice that the cleat system surrounds the coal matrix. The relative locations where the partial pressures of coalbed methane are calculated in the cleats and the coal matrix are also shown in FIG. 6. During the injection phase of this invention, coalbed stimulation gas replaces a portion of the water as part of the displacement process. Initially, the gas in the cleat system will contain a low-volume fraction of methane and therefore, be at a low partial pressure of methane. The idealized relationship that equates partial pressure of coalbed methane in the cleats to local cleat pressure and volume fraction of coalbed methane is shown by the following equation:

$$P_{CH_4} = P_{CLEAT} \times V_{CH_4}, \text{ where}$$

$P_{CH_4}$=partial pressure of coalbed methane in the cleats;

$P_{CLEAT}$=Absolute pressure in the cleat at a particular spatial location; and $V_{CH_4}$=Volume fraction of coalbed methane in the cleat measured at the same location as $P_{CLEAT}$ A conceptual relationship that relates the gas desorption rate from the coal matrix to the cleats as a function of their respective partial pressures is shown by the following equation:

$$Q_{DSORB} = K \times (P_{COAL} - P_{CH_4}) \text{ where}$$

$Q_{DSORB}$=Rate of coalbed methane desorption from coal matrix to the cleat system;

K=A group of terms assumed to be constant for this example;

$P_{COAL}$=Partial pressure of coalbed methane adsorbed onto the surface of the coal matrix at a particular spatial location; and $P_{CH_4}$=Partial pressure of coalbed methane existing in the cleats measured at the same location as $P_{COAL}$ The above mentioned relationships will show a close dependence between rate of desorption and the difference in partial pressure, which is called the diffusional, partial-pressure driving force. All of the above-mentioned factors should increase the coalbed methane production rate and decrease the water production rate. More complex relationships are possible and may require the use of a numerical simulator such as WRICBM model entitled "Development Of A Portable Data Acquisition System And Coalbed Methane Simulator, Part 2: Development Of A Coalbed Methane Simulator" which is attached to this application and hereby incorporated by reference. The equations defined within WRICBM are time dependent, interrelated (coupled) and non-liner in nature. WRICBM uses an iterative, simultaneous method to solve the equations for each discrete volume element or coalbed characteristic of a coalbed at every point in time. A general and simplified description of the WRICBM's formulation and equation set follows.

WRICBM models a dual-porosity formation in which a stationary, non-porous, non-permeable matrix communicates with a porous, permeable matrix. The stationary matrix represents the coal. The permeable matrix represents the coalbed's cleat (fracture) system. Water and gases only flow within the permeable matrix. Gases exchange between the stationary and matrix elements. This feature simulates gas desorption/sorption between the coalbed's coal and cleat systems. The movement of gases and water phases within the permeable matrix are described by the generally accepted multi-phase modification of Darcy flow. Therefore, the transport of the fluids are subject to the effects of pressure gradients for each phase, fluid viscosity, absolute permeability, and liquid-gas phase relative permeability. The rate and quantity of gas desorption/sorption between the stationary and permeable matrix systems can optionally be determined by equilibrium controlled, pseudo-unsteady state controlled, and fully unsteady state controlled transport mechanisms. Equilibrium transport assumes that the pressure in the coal is the same as the pressure in the local fracture system. Thus, there is no time delay for gas sorbing or desorbing with respect to the coal. The pseudo-unsteady state transport assumes an average concentration of gas sorbed within the coal and a diffusional time delay for sorbed gas movement within the coal. Fully unsteady state transport assumes a concentration gradient of sorbed gas within the coal element with a diffusional delay for sorbed gas movement within the coal. For the unsteady state methods, the sorbed gas concentration at the surfaces of each coal element are functions of the local partial pressures at the cleat matrix. Partial pressure is the product of the reservoir pressure and the individual mole fraction of each gas species present. The multi-component, Extended Langmuir relationship relates the quantity of individual gas component sorbed to respective gas partial pressure.

The following set of equations are solved simultaneously within WRICBM at each discrete timestep for each differential element of coalbed:

1. Material balance for water
2. Material balance for each gas component present in the stationary-matrix, permeable-matrix system As stated previously, Darcy flow describes the transport of material with respect to each differential element's permeable matrix. The quantity of gas desorbed/sorbed for each component is represented in the respective gas material balance equation by a source term. The rate of gas desorption/sorption is dependent on the local partial pressure for each permeable matrix's differential element and the corresponding sorbed concentration of each gas component.

WRICBM calculates the flow of water and gas phases at the wells in the standard way. The calculation uses viscosity for the phases, differential pressure between each phase's matrix pressure and the wellbore, and a productivity index that accounts for the radical nature of the well's drainage. Source terms couple the well equations to the individual material balance equations.

As a result the invention has many embodiments and may be implemented in different ways to optimize the production of coalbed methane. The option selected will depend on the determined characteristics of the coalbed reservoir and the conditions at the production well. This model may be invaluable in utilizing the disclosed absorption and desorption rate calculation elements, water displacement rate calculation elements, stimulation gas amount calculation elements, coalbed gas removal calculation elements, and reduced permeability gas pressure calculation elements, although calculation elements may used manually or otherwise. Optimizing this process may require a knowledge of reservoir engineering and the use of a coalbed methane simulator.

Figure 7:
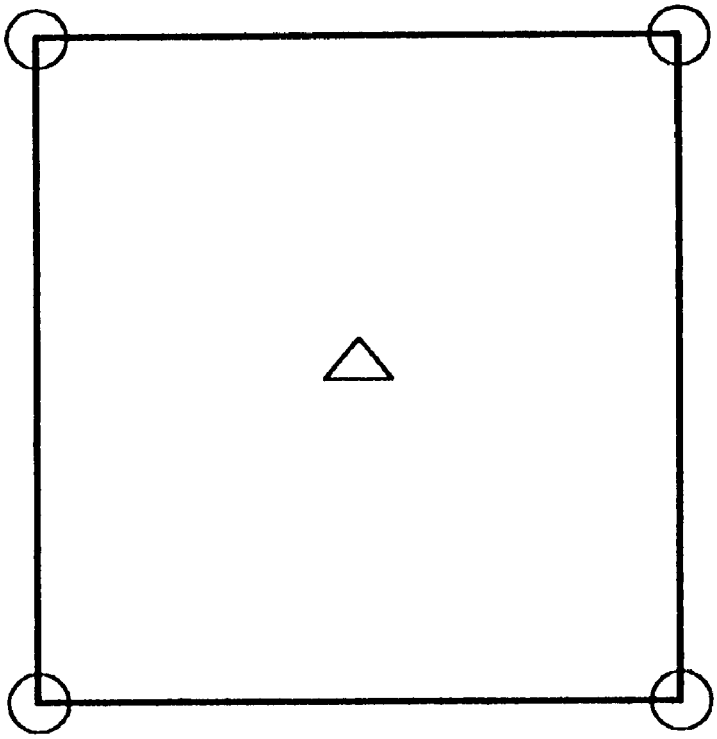
FIG. 7 is a particular embodiment of the pattern of a production well in relation to water confinement wells.

One embodiment of the invention uses a production well (12) to both deliver stimulation gas (1) to the coalbed gas reservoir and for the removal of coalbed gas (14) from the coalbed gas reservoir (11). As mentioned above this approach is different than most conventional coalbed gas production techniques which use a separate gas stimulation well and a separate coalbed gas production well. Using the production well for both purposes eliminates many of the problems associated with conventional production methods which include excessive water production at the coalbed gas production well, contamination of the produced coalbed gas with excessive amounts of stimulation gas and the unintended alteration of the coalbed structure to mention a few. With regard to the instant invention, the gas may be injected into the coalbed for a brief period of time through the production well and the amount of stimulation gas may be limited. The producer may be subsequently placed back on production, and a dramatic increase in coalbed methane recovery and reduction in water production results. This approach may be applied to coalbeds that are either substantially dry with little or no mobile water saturation or applied to coalbeds that have a portion or all of the coalbed saturated with water (6). In the former case, the increase in production would not significantly involve changes in permeability to the water or gas phases but will involve desorption of gas from the coal matrix and possibly the immobile water. In the later case, the water in the coalbed may be displaced from a large area surrounding the production well by the delivery of the stimulation gas to the production well. The de-watered coalbed gas reservoir volume may define a water displacement perimeter (7). This invention or approach may require the use of surrounding producers or water confinement wells (8) in addition to the stimulated well (or wells). During production of the stimulated wells, these additional producers can limit the encroachment of water that has been displaced from the coalbed by the gas injection procedure. Used in the ways described above, these surrounding wells may be regarded as conventional, unstimulated producers or as water confinement wells that act as barriers between the stimulated coalbed region and the surrounding aquifer. In a particular application of the embodiment and as shown in FIG. 7, the production well may be located at the centroid of a tract of land having an area of between approximately 40 and 320 acres. The tract of land may optimally have a substantially square perimeter but this may not necessarily be the case. Water confinement wells may be located approximately at the comers of the substantially square perimeter to remove water encroaching upon the de-watered coalbed surrounding the production well. The coalbed may be stimulated by injecting coalbed stimulation gas through the production well for a brief period of eight to twelve days with an amount of coalbed stimulation gas to sweep a substantial portion of the dewatered coalbed reservoir. The injection of coalbed stimulation gas may be terminated and the same well may be used for removal of coalbed gas and possibly water at a rate which lowers the coalbed pressure in the coalbed and which is optimally never less than the rate at which the coalbed gas is desorbed from the coalbed. A number of adjacent tracts of land may be produced simultaneously by this method as yet another application of this same embodiment. This method may also be used on virgin or previously produced coalbed gas reservoirs.

A second embodiment of this invention is to decrease the water permeability of the coalbed formation. As mention above and as shown in FIG. 4 increased water contained in a coalbed allows increased flow of water to the coalbed. Permeability, as mentioned above, is also a characteristic of coalbeds that have had the coalbed structure altered by some conventional high pressure injection techniques. The instant invention assesses the hydrostatic pressure of water associated with the coalbed surrounding a production well. Subsequently, a coalbed stimulation gas having a pressure greater than the hydrostatic pressure but with a pressure calculated to avoid altering the structure of the coalbed is injected into the production well. A reduced water permeability calculation element may be used to assist in these calculations. The pressure of the injected coalbed stimulation gas limited to a pressure not substantially greater than the hydrostatic pressure displaces at least a portion of the water in the coalbed without altering the coalbed structure. The de-watered coalbed having the same structure may be a reduced water permeability. To the extent that the reduced water permeability excludes water from the coalbed reservoir the economic life of the coalbed is extended, a reduced volume of water has to be removed by water confinement wells, and the coalbed gas produced may contain less water. In fact, overall water production should be lower than with any production scheme (ECBM or otherwise) because of the displacement of water from the coal and the reduced permeability to water. Water handling costs should be lower as well, particularly relative to the quantities of coalbed methane produced. Naturally, this technique could be used in applications other than the production of coalbed gas where water permeability of the subterranean formation is important.

Another embodiment of this invention comprises maintaining increased desorption of coalbed gases from the surface of the organic matrix of subterranean formation or coalbed. The production of coalbed gas from a de-watered coalbed can involve: (1) production of gas and lowering of pressure in the immediate vicinity of the wellbore; (2) the desorption of coalbed methane from the coal matrix into the cleats due to the pressure reduction; and (3) the accelerated production of mobile coalbed methane gas from the coalbed as the radius of influence of the pressure drawdown increases throughout the coalbed. These may be are optimized when the coalbed gas desorption rate is known and the removal rate of coalbed gas from the coalbed is never less than the desorption rate from the surface of the organic matrix of the coalbed or subterranean formation. However, withdrawal rates must not be so great as to lower the pressure of the formation so as to draw water into the coalbed. One aspect of this invention is therefore, a method of estimating the desorption rate of the coalbed gas from the coalbed by calculating a coalbed gas desorption rate at which the coalbed gas desorbs from the coalbed. Producing the estimate may involve the use of a desorption rate calculation elements in the model. Based on this estimate, a gas removal rate is determined which is optimally never less than the calculated coalbed gas desorption rate. Determing the coalbed gas removal rate may involve the use of a gas removal rate calculation element. Subsequently, the coalbed gas is removed from the production well at the calculated coalbed gas removal rate. Since this removal rate may be calculated to be a value not substantially greater than the desorption rate the coalbed may have a pressure which induces the least amount of water to be drawn into the coalbed. The water confinement wells may also be used to assist in the removal of coalbed gas to maintain or establish a reduced coalbed gas reservoir pressure within the region of stimulated production wells.

In an additional embodiment of the invention, an appropriate amount of coalbed stimulation gas to be used based upon determined characteristics of the coalbed. One such characteristic may be sorbed coal gas volume although other characteristics could be determined and additionally the characteristics may be interdependent on one another. Simulations may have to be run to weigh these characteristics to estimate the stimulation gas having an appropriate amount to stimulate the coalbed reservoir. Because the amount of stimulation gas estimated is the minimum amount to stimulate the coalbed gas reservoir, coalbed gas removed from the production well may not require cleanup for pipeline use. In simulations of the present method with nitrogen, the nitrogen content of the initially produced gas may be less than ten volume percent and optimally less than four volume per cent, under stable stabilized coalbed gas removal conditions, and the percentage may decrease with time. The clean coalbed gas having low levels of contamination by nitrogen, results from the limited quantities of stimulation gas injected and its dilution from the large quantities of the coalbed methane gas mixture produced after stimulation.

In yet another embodiment of the invention, the stimulation of a producer may be accomplished by mechanical or chemical alteration of the coal and coalbed's physical structure. These stimulation methods employ high pressure coalbed stimulation gas, acid treatments or other coalbed alteration elements to induce fracturing and creation of cavities (cavitation). These forms of stimulation either extend the well's drainage radius by improving the coal's absolute permeability or increase the well's productivity index. Thus, the mechanical and chemical techniques stimulate wells differently than the present invention and should be considered as a separate and distinct method of enhancing production. However, it may be possible to achieve a further increase in production by applying the present invention in addition to a mechanical or chemical stimulation. In any case, a limited degree of fracturing may occur in the immediate vicinity of the well bore when the present invention is applied to a soft coal. This minor degree of fracturing is probably an unavoidable consequence of injecting air into the pressurized coalbed.

In another embodiment of the invention, several adjacent producers within a field may be stimulated simultaneously. This technique would de-water a large portion of the reservoir before the commencement of production. The period of gas injection could be increased at a central well or to establish gas saturation at surrounding producers. This technique may de-water a large region of the coalbed using a single well. A single well within a pattern could be stimulated for a limited period before being placed on production. In this case, the outer wells could serve as barriers to prevent water encroachment and to further reduce the overall pressure in the reservoir. Finally, a central region of the reservoir comprising several wells can be de-watered by gas injection, and a surrounding pattern of unstimulated producers can be used to prevent water encroachment into the dewatered area.

In yet another embodiment, the stimulation technique may be repeated on a particular well (or wells). The technique may also be used on wells that were previously produced by conventional means and are therefore partially de-watered. The increase in recovery may not be as dramatic as its application to a virgin reservoir, but it may be significant.

In many of the above mentioned embodiments the stimulation compression costs are significantly reduced. This invention does not always employ high injection pressures. In fact, it is most efficiently operated by maintaining the lowest possible processing and reservoir pressures. It is only necessary to moderately exceed the prevailing hydrostatic gradient. In addition, the gas injection (or stimulation cycle) is only performed for a brief period. In comparison, a typical ECBM procedure requires continuous or almost continuous injection at high injection pressures and gas rates to drive the gas mixture to the producer.

Lastly, this invention may be applied to any reservoir material or subterranean formation whose gas is physically held (sorbed) onto the surface of an organic matrix and can be released by a reduction in pressure. In this manner water associated with a portion of the coalbed is displaced away from the coalbed.

EXAMPLES

Figure 8:
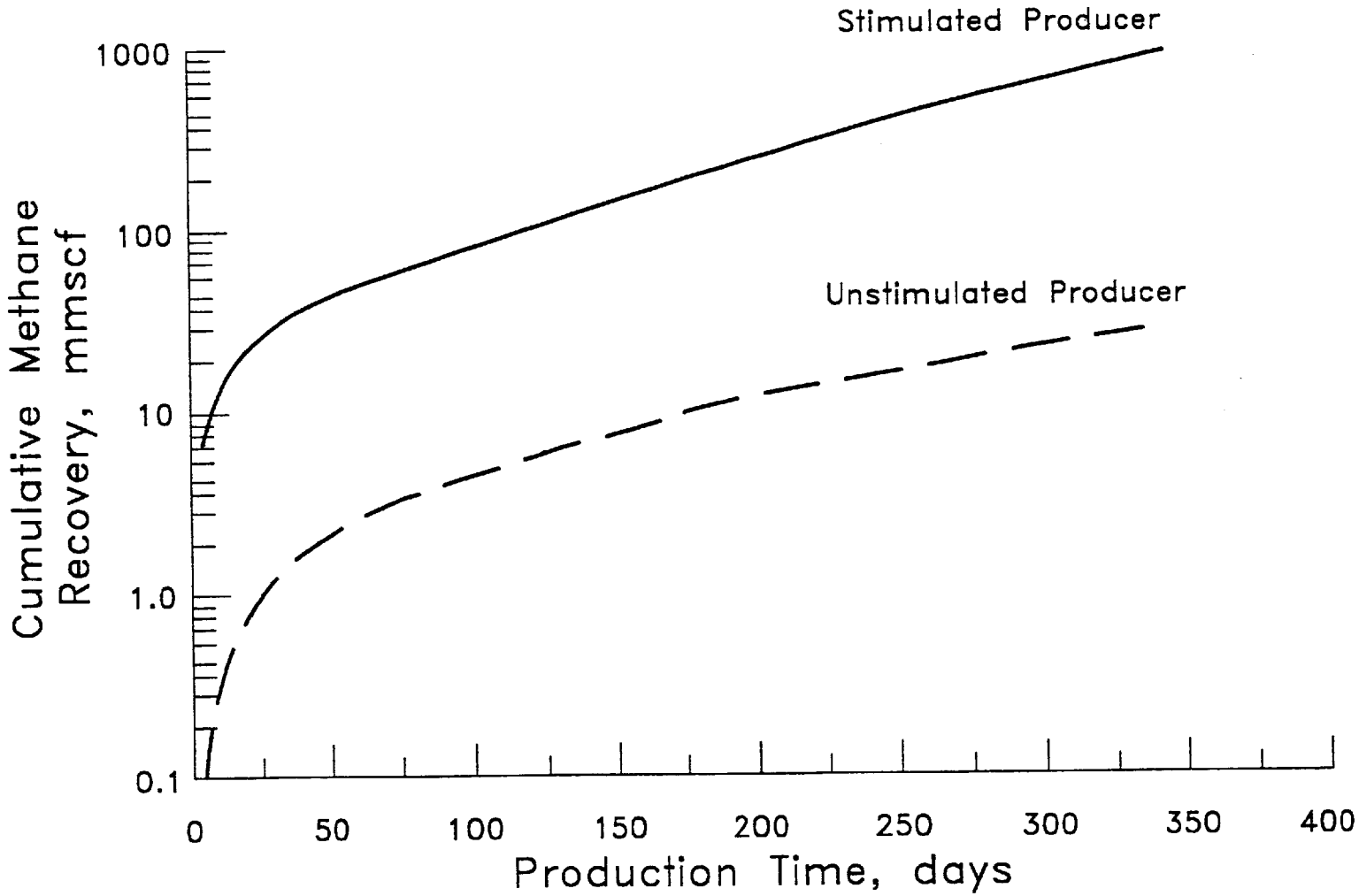
FIG. 8 is a graph which compares the coalbed gas production from an unstimulated coalbed and a stimulated coalbed gas using a particular embodiment of this invention with nitrogen.

The following examples of both apparatus and methods for coalbed gas reservoir simulation are representative and do not limit the possible scenarios and variations of using this invention. A stimulation gas is applied to a production well located within a five-spot repeated pattern of producers on 320-acre spacings as shown in FIG. 7. The coalbed is fully water-saturated and has not been previously produced. The permeability of the coalbed is 1 Darcy, and its depth is 700 ft. A stimulation of the coalbed reservoir is performed by injecting 60 thousand standard cubic feet per day for 10 days. The producer is subsequently placed on production for the remainder of one year. The cumulative coalbed methane production as a function of time is shown in FIG. 8. Also shown in FIG. 8 is the cumulative coalbed methane production that results from a conventional gas depletion procedure. The stimulated well yields a 30-fold increase in cumulative production compared to the conventionally produced well. The gas: water ratios for the stimulated and unstimulated wells were 3.9 and 0.12 mscf/bbl, respectively. The maximum nitrogen content in the stimulated producer's product gas was 3.0 volume percent. This example demonstrates the dramatic increases in coalbed gas production that are possible with this invention. It is also illustrative of the potential commercial benefit that can be derived from the production of clean coalbed gas that does not require any further cleanup prior to introduction into a gas supply pipeline.

Figure 9:
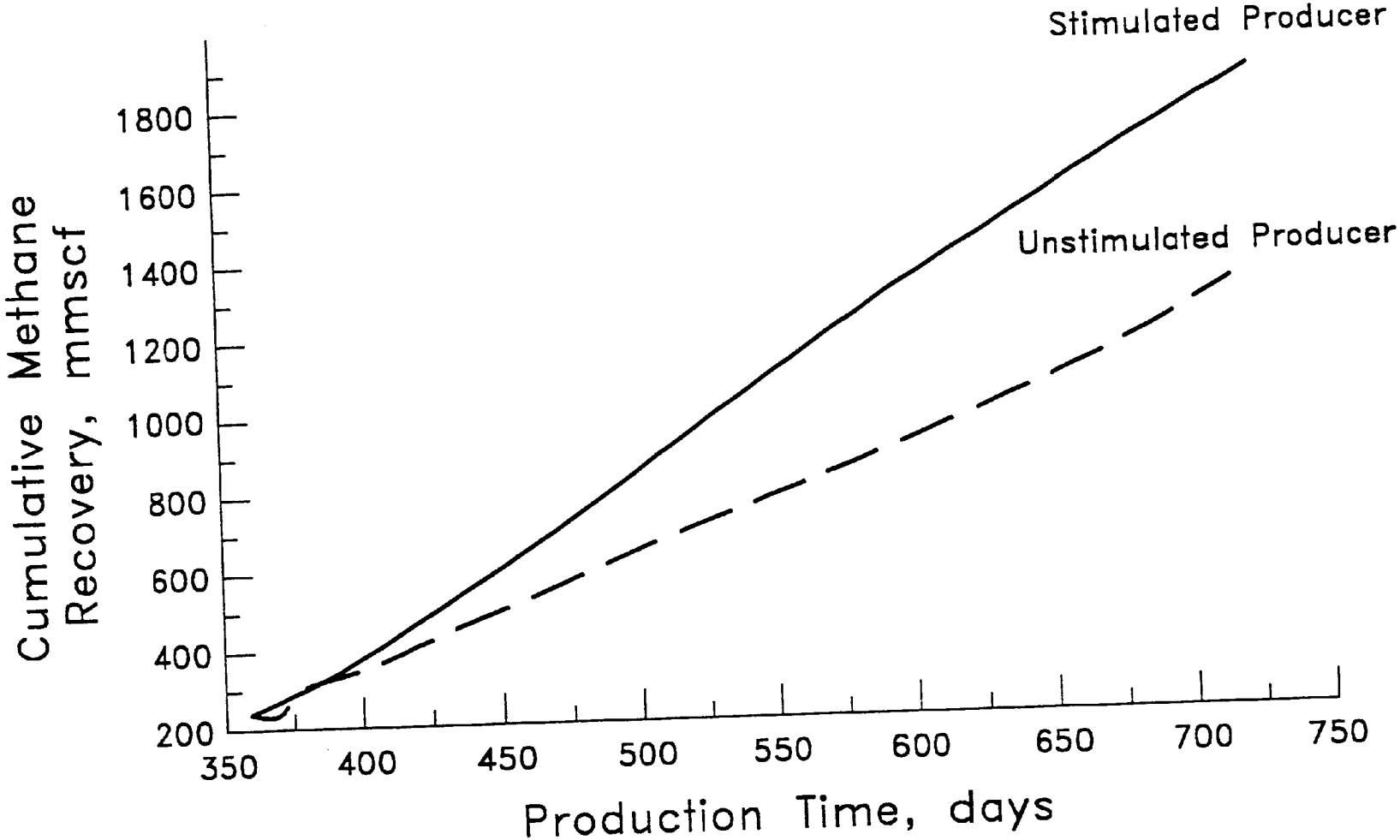
FIG. 9 is a graph which compares the coalbed gas production from a stimulated coalbed using the instant invention which was previously produced by conventional unstimulated coalbed methods.

As a second example, a stimulation was performed on a well that was previously on production by a conventional depletion method for one year. The reservoir description and production well pattern are the same as for the first example. A 10-day stimulation was performed as before. The cumulative production history for the stimulated well and the well that is continuing to be produced on primary are compared for the second year of production as shown in FIG. 9. The stimulated well produced 40 volume percent more coalbed methane. The gas: water ratios for the stimulated and unstimulated procedures were 8.7 and 6.1 mscf/bbl, respectively. The maximum nitrogen content in the stimulated producer's product gas was less than 5.0 volume percent. This example demonstrates that a substantial increase in coalbed methane production is possible when the technique is applied to a well that is already under production.

It should be understood that the apparatuses and methods of the embodiments of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all action may be expressed as a means for taking that action or as an element which causes that action. Similarly, each physical element disclosed should be understood to encompass a disclosure of the action which that physical element facilitates. Regarding this last aspect, and as but one example the disclosure of a "stimulated coalbed reservoir" should be understood to encompass disclosure of the act of "stimulating a coalbed reservoir"—whether explicitly discussed or not—and, conversely, were there only disclosure of the act of "stimulating a coalbed reservoir", such a disclosure should be understood to encompass disclosure of a "stimulated coalbed reservoir". Such changes and alternative terms are to be understood to be explicitly included in the description.

Any references mentioned, including but not limited to the references in the application to a "Development Of A Portable Data Acquisition System And Coalbed Methane Simulator, Part 2: Development Of A Coalbed Methane Simulator", are hereby incorporated by reference or should be considered as additional text or as an additional exhibits or attachments to this application to the extent permitted; however, to the extent statements might be considered inconsistent with the patenting of this/these invention(s) such statements are expressly not to be considered as made by the applicant. Further, the disclosure should be understood to include support for each feature, component, and step shown as separate and independent inventions as well as the various combinations and permutations of each.

What is claimed is:

1. A system for coalbed gas production, comprising:

a. a coalbed;

b. coalbed gas sorbed to coal in said coalbed;

c. at least one production well which communicates with said coalbed gas;

d. a coalbed gas reservoir having determined characteristics;

e. an amount of coalbed stimulation gas appropriate to said determined characteristics of said coalbed gas reservoir;

f. a coalbed stimulation gas transfer element which delivers said amount of stimulation gas to said coalbed in a vicinity about said at least one production well;

g. desorbed coalbed gas from said coal in said coalbed gas reservoir;

h. a coalbed gas removal element; and i. an amount of clean coalbed gas removed from said coalbed.

2. A system for coalbed gas production as described in claim 1, wherein said amount of coalbed stimulation gas comprises an amount of coalbed stimulation gas appropriate to stimulate said coalbed gas reservoir having said determined characteristics to produce said clean coalbed gas containing less than about four percent stimulation gas per unit volume under stabilized coalbed gas removal conditions.

3. A system for coalbed gas production as described in claim 1, wherein said amount of coalbed stimulation gas comprises an amount of coalbed stimulation gas appropriate to stimulate said coalbed gas reservoir having said determined characteristics to produce said clean coalbed gas containing less than about ten percent stimulations gas per unit volume under stabilized coalbed gas removal conditions.

4. A system for coalbed gas production as described in claim 1, further comprising a calculated coalbed gas desorption rate at which said coalbed gas desorbs from said coal and wherein said coalbed gas removal element has a calculated average coalbed gas removal rate which is never less than said calculated coalbed gas desorption rate.

5. A system for coalbed gas production as described in claim 4, further comprising:

a. water in at least a portion of said coalbed gas reservoir;

b. a water displacement perimeter; and c. at least one water confinement well which communicates with said coalbed to remove water encroaching on said water displacement perimeter.

6. A system for coalbed gas production as described in claim 5, wherein said at least one water confinement well which communicates with said coal is located at said water displacement perimeter.

7. A system for coalbed gas production as described in claim 5, wherein said at least one coalbed gas removal element coupled to said at least one confinement well assists said at least one coalbed gas removal element to remove coalbed gas at said calculated coalbed gas removal rate which is never less than said calculated coalbed gas desorption rate.

8. A system for coalbed gas production as described in claim 5, wherein said at least one production well has a location at about a centroid of an approximately 40 to 320 acre tract of land.

9. A system for coalbed gas production as described in claim 8, wherein said at least one water confinement well has a location at the extent of said approximately 40 to 320 acre tract of land.

10. A system for coalbed gas production as described in claim 5, wherein said at least one water confinement well has a location at about a boundary of a production well drainage radius for said at least one production well.

11. A system for coalbed gas production as described in claim 5, wherein said coalbed stimulation gas has a pressure calculated to avoid altering the structure of said coalbed and wherein said stimulation gas pressure induces a reduced water permeability to said stimulated coalbed gas reservoir.

12. A system for coalbed gas production as described in claim further comprising a coalbed structure alteration element which acts after a portion of said coalbed gas is removed from said stimulated coalbed reservoir.

13. A system for coalbed gas production as described in claim 9, wherein said approximately 40 to 320 acre tract of land has a substantially square perimeter.

14. A system for coalbed gas production as described in claim 13, wherein said approximately 40 to 320 acre tract of land having a substantially square perimeter is adjacent to another approximately 40 to 320 acre tract of land having a substantially square perimeter having a production well.

15. A system for coalbed gas production as described in claim 1, 2, 4, 5, 6 or 7, wherein said coalbed stimulation gas is selected from a group consisting of nitrogen, carbon dioxide, air, or a gas less sorptive to coal than methane.

16. A method of producing coalbed gas, which comprises the steps of:

a. locating a coalbed having coalbed gas sorbed to coal;

b. establishing at least one production well to communicate with said coalbed gas;

c. determining a characteristic of said coalbed;

d. calculating an appropriate volume of a coalbed stimulation gas to inject into said coalbed having said characteristic;

e. injecting said calculated volume of said coalbed simulation gas into said coalbed reservoir;

d. stimulating said coalbed gas reservoir;

f. desorbing at least a portion of said coalbed gas sorbed onto said coal in said stimulated coalbed reservoir; and g. removing clean coalbed gas from said coalbed reservoir.

17. A method of producing coalbed gas as described in claim 16, wherein said step of calculating said appropriate volume of said stimulation gas to inject into said coalbed gas reservoir comprises calculating said volume of said stimulation gas which results in produced coalbed gas from said production well having less than about ten per cent stimulation gas per unit volume of produced coalbed gas.

18. A method of producing coalbed gas as described in claim 16, wherein said step of calculating said appropriate volume of said stimulation gas to inject into said coalbed gas reservoir comprises calculating said volume of said stimulation gas which results in produced coalbed gas from said production well having less than about four per cent stimulation gas per unit volume of produced coalbed gas.

19. A method of producing coalbed gas as described in claim 18, further comprising the steps of calculating a coalbed gas desorption rate at which said coalbed gas desorbs from said coal and wherein said step of removing coalbed gas from said coalbed reservoir has a calculated average rate which is never less than said calculated coalbed gas desorption rate.

20. A method of producing coalbed gas as described in claim 19, wherein said step of removing coalbed gas from said coalbed reservoir at said calculated coalbed gas removal rate comprises removing coalbed gas from at least one water confinement well.

21. A method of producing coalbed gas as described in claim 20, further comprising the steps of:

a. locating water in at least a portion of said coalbed gas reservoir;

b. calculating a water displacement pressure not substantially larger than said hydrostatic pressure to displace at least a portion of said water from said coalbed gas reservoir;

c. displacing said water in said at least a portion of said coalbed gas reservoir;

d. establishing a water displacement perimeter;

e. establishing at least one water confinement well to communicate with said water located at about said water displacement perimeter; and f. maintaining said water displacement perimeter by removing said water encroaching upon said water displacement perimeter.

22. A method of producing coalbed gas as described in claim 21, which further comprises the steps of:

a. injecting a gas into said coalbed having an injection gas pressure sufficient to reduce the water permeability of said coalbed;

b. displacing said water from at least a portion of said coalbed without substantially altering said coalbed structure;

c. reducing the water permeability of said coalbed;

d. excluding at least a portion of said water from entering to said reduced permeability coalbed.

23. A method of producing coalbed gas as described in claim 22, wherein said step of injecting a gas into said coalbed having an injection gas pressure sufficient to reduce the water permeability of said coalbed comprises calculating a approximate minimum stimulation gas pressure to reduce the water permeability of said coalbed reservoir.

24. A method of producing coalbed gas as described in claim 23, which further comprises the step of cavitating the coalbed gas reservoir.

25. A coalbed gas produced in accordance with the method of claim 16, 18, 19, 21, 22, or 24.

26. A method of producing coalbed gas as described in claim 16, 18, 19, 21, 22, or 24, wherein said step of establishing at least one production well comprises locating said at least one production well at about a centroid of an approximately 40 acre to 320 acre tract of land.

27. A method of producing coalbed gas as described in claim 26, wherein said step of establishing at least one water confinement well comprises locating four water confinement wells located at the comers of a substantially square perimeter encompassing said approximately 40 acre to 320 acre tract of land.

28. A method of producing coalbed gas as described in claim 27, which further comprises the step of locating said at least one production well adjacent to another approximately 40 acre to 320 acre tract of land having a production well.

29. A method of producing coalbed gas as described in claim 28, wherein said step of injecting a stimulation gas into said coalbed reservoir comprises injecting stimulation gas selected from a group consisting of nitrogen gas, carbon dioxide gas, air, or a gas less sorptive to coal than methane.

30. A system for coalbed gas production as described in claim 1, wherein said coalbed stimulation gas transfer element which delivers said amount of stimulation gas to said coalbed in a vicinity about said at least one production well is coupled to said at least one production well to deliver said amount of stimulation gas through said at least one production well.

31. A system for coalbed gas production as described in claim 29, wherein said gas removal element is coupled to said at least one production well to remove gas through said at least one production well.

32. A system for coalbed gas production as described in claim 31, wherein said gas removal element is coupled to said at least one water confinement well to remove at least a portion of said amount of clean gas through said at least one water confinement well.

33. A method of producing coalbed gas as described in claim 19, wherein said step of removing coalbed gas from said coalbed reservoir at said calculated coalbed gas removal rate comprises removing coalbed gas from said at least one production well.

* * * * *

UNITED STATES PATENT AND TRADEMARK OFFICE

CERTIFICATE OF CORRECTION

PATENT NO. : 6,244,338 B1
APPLICATION NO. : 09/338295
DATED : June 12, 2001
INVENTOR(S) : Charles G. Mones It is certified that error appears in the above-identified patent and that said Letters Patent is hereby corrected as shown below:

*The following paragraph should appear at Column 1, line 7*

ACKNOWLEDGMENT OF GOVERNMENT SUPPORT

This patent relates to work performed under U.S. DOE Cooperative Agreement #DE-FC26-98FT40323. The U.S. government may have certain rights in this inventive technology, including "march-in" rights, as provided for by the terms of U.S. DOE Cooperative Agreement #DE-FC26-98FT40323.

Signed and Sealed this

Thirteenth Day of July, 2010

David J. Kappos

David J. Kappos
*Director of the United States Patent and Trademark Office*